US010493339B2

(12) United States Patent
Gait

(10) Patent No.: US 10,493,339 B2
(45) Date of Patent: Dec. 3, 2019

(54) LACROSSE STICK HEAD CONFIGURED FOR FACE-OFFS

(71) Applicant: Paul Gait, Altamont, NY (US)

(72) Inventor: Paul Gait, Altamont, NY (US)

( * ) Notice: Subject to any disclaimer, the term of this patent is extended or adjusted under 35 U.S.C. 154(b) by 0 days.

(21) Appl. No.: 16/252,034

(22) Filed: Jan. 18, 2019

(65) Prior Publication Data

US 2019/0232134 A1 Aug. 1, 2019

Related U.S. Application Data

(60) Provisional application No. 62/619,217, filed on Jan. 19, 2018.

(51) Int. Cl.
*A63B 59/20* (2015.01)
*A63B 102/14* (2015.01)

(52) U.S. Cl.
CPC ..... *A63B 59/20* (2015.10); *A63B 2102/14* (2015.10)

(58) Field of Classification Search
CPC ..... A63B 59/20; A63B 2102/14; A63B 60/00; A63B 60/46
USPC ..... 473/512, 513
See application file for complete search history.

*Primary Examiner* — John E Simms, Jr.
*Assistant Examiner* — Rayshun K Peng
(74) *Attorney, Agent, or Firm* — Scarinci Hollenbeck, LLC

(57) ABSTRACT

A lacrosse head for a lacrosse stick is provided. The lacrosse head has an open frame having a rearward base, a scoop opposing the base, and a pair of sidewalls extending between the base and the scoop. The lacrosse head has a throat portion projecting rearward from the open frame for receipt of a lacrosse handle element therein so as to define a head/handle axis projecting forwardly of the throat portion. The open frame has a plurality of holes for securing a lacrosse net along a back side of the frame, leaving an opposing front side of the frame open for receiving a lacrosse ball. Each of the pair of sidewalls has a bottom portion and a top portion. Each of the bottom edge of the sidewalls angles to the right. The bottom edge of the left sidewall angle inwardly and the bottom edge of the right angles outwardly, in relationship to the top edge of the sidewalls. The distance between each sidewall stays the same distance or gets wider than the distance between the top edge of the sidewalls.

9 Claims, 5 Drawing Sheets

LACROSSE STICK HEAD CONFIGURED FOR FACE-OFFS

FIELD OF THE INVENTION

This disclosure relates generally to a lacrosse stick head and more particularly, to a lacrosse head that can more easily receive a lacrosse ball on its back side during lacrosse face-offs.

BACKGROUND

Current lacrosse heads are typically constructed of an open frame having a base with a concave interior surface that defines a ball rest, a pair of sidewalls that diverge from the base, and a scoop that interconnects the sidewalls remotely of the base. Openings or other attachment structures are integrated into the frame for securing a lacrosse net around the back side of the frame, leaving the opposing front side of the frame open for receiving lacrosse balls. A throat or other structure exteriorly projects from the base of the frame and has a socket formed therein for attachment to a handle. The handle and throat attachment define a handle/head axis, which typically, although not necessarily forms, the central axis and/or an axis of lateral symmetry of the head. A portion of the front side of the head is conventionally disposed in a plane parallel to the handle/head axis.

While there have been many lacrosse heads, offered commercially, with unique and varying sidewalls designed to lower the pocket from the central axis created by the head/handle, there have been none that have offered an asymmetrical bottom sidewall edge. While these head configurations, which vary from the traditional configuration, provide different characteristics with regard to playability and feel, they do not address the concern of improving the lacrosse heads ability to receive a ball from the back side of a lacrosse head during facing off.

None of these prior lacrosse heads, provide any structure to lower the bottom edge of the sidewalls so that the upper sidewall can maneuver under the apponents upper sidewall and lower sidewall can be closer to the ground so the ball can easily roll into the backside of the pocket.

BRIEF SUMMARY

Object of the invention is to provide a lacrosse head that is configured to improve the ability to receive a lacrosse ball in the back side of the pocket during lacrosse face offs.

It is a related object of the present invention to provide a lacrosse head with the bottom portion, of the sidewalls, that angle toward the ground when the right sidewall is placed on the field of play.

It is another object of the present invention to have the bottom edge, of the left sidewall, angle inward to allow it to fit inside the opposing players bottom sidewall edge.

It is another object of the present invention to have the bottom edge, of the right sidewall, angle outward to allow it to lay closer to the ground, when the right side of the stick is placed on the ground.

It is another object of the present invention to have the top edge of the sidewalls be symmetrical to the centerline of the head to maintain balance.

In accordance with the above objects of the present invention, a lacrosse head for a lacrosse stick is provided. The lacrosse head has an open frame having a rearward base, a scoop opposing the base, and a pair of sidewalls extending between the base and the scoop. The lacrosse head has a throat portion projecting rearward from the open frame for receipt of a lacrosse handle element therein so as to define a head/handle axis projecting forwardly of the throat portion. The open frame has a plurality of holes for securing a lacrosse net along a back side of the frame, leaving an opposing front side of the frame open for receiving a lacrosse ball. Each of the pair of sidewalls has a bottom portion and a top portion. Each of the bottom edge of the sidewalls angles to the right. The bottom edge of the left sidewall angle inwardly and the bottom edge of the right angles outwardly, in relationship to the top edge of the sidewalls. The distance between each sidewall stays the same distance or gets wider than the distance between the top edge of the sidewalls.

In accordance with another object of the present invention, the left and right sidewalls have different support material designed so that each sidewall has a unique flex point from one another These and other features and advantages of the present invention will become apparent from the following description of the invention, when viewed in accordance with the accompanying drawings and appended claims.

BRIEF DESCRIPTION OF THE DRAWINGS

This disclosure is further described in the detailed description that follows, with reference to the drawings, in which.

DETAILED DESCRIPTION

An exemplary embodiment of a lacrosse stick head configured for face-offs is disclosed. As required, detailed embodiments of the present invention are disclosed herein; however, it is to be understood that the disclosed embodiments are merely exemplary of the invention that may be embodied in various and alternative forms. The figures are not necessarily to scale and some features may be exaggerated or minimized to show details of particular components. Therefore, the structural and functional details disclosed herein are not to be interpreted as limiting, but merely as a representative basis for teaching one skilled in the art to variously employ the present invention.

Figure 1:
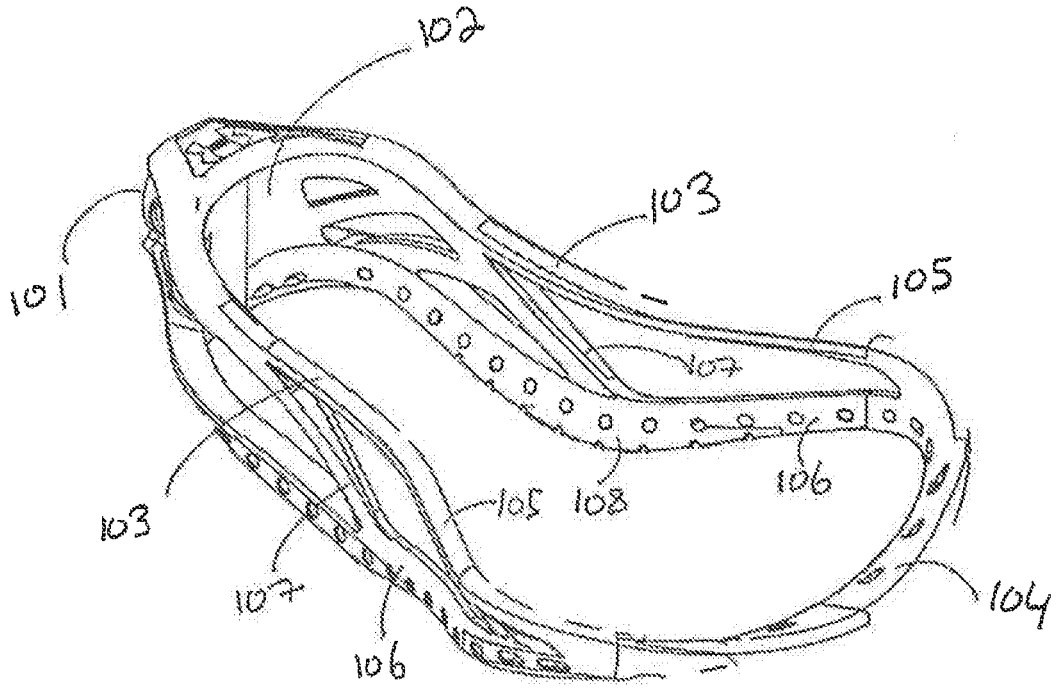
FIG. 1 is a perspective view of a lacrosse stick head configured for face-offs according to one embodiment.

In FIG. 1, a perspective view of a lacrosse stick head configured for face-offs according to one embodiment is shown. As shown in FIG. 1, in one embodiment, the lacrosse head 100 includes a socket 101 configured to receive a lacrosse stick shaft, and a base region 102 adjacent to the socket 101. Sidewalls 103 extend from the base region 102 and terminate at a scoop 104. Each sidewall 103 includes an upper rail 105 extending from the base region 102 and a lower rail 106 connected to the upper rail 105 via support arms 107. Eyelets 108 or other types of openings, to which netting or other suitable lacrosse pocket materials may be connected, are include in the lower rails 106. The various lacrosse head components may be made of a plastic material or any other suitable material.

Figure 2:
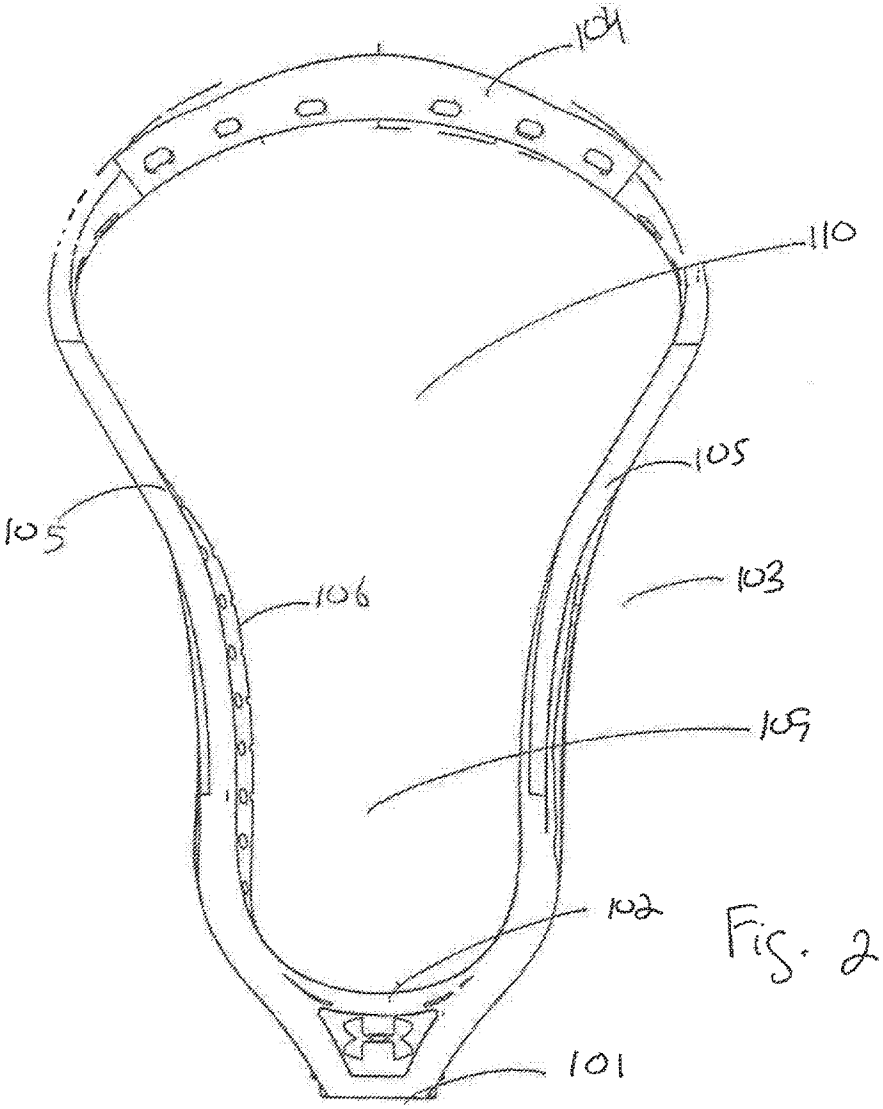
FIG. 2 is a front view of the lacrosse stick head configured for face-offs.

In FIG. 2, a front view of the lacrosse stick head configured for face-offs is shown. As shown in FIG. 2, the sidewalls 103 initially extend upward in parallel from the base region 102 forming a lower pocket region 109 until an approximate midpoint along the longitudinal axis of the head 100 running form the socket 101 to the scoop 104. At the approximate midpoint, the sidewalls 103 continue to extend upward and outward in opposite directions forming a larger upper pocket region 110 until they terminate to form the scoop 104 at the upper end of the head 100.

Figure 3:
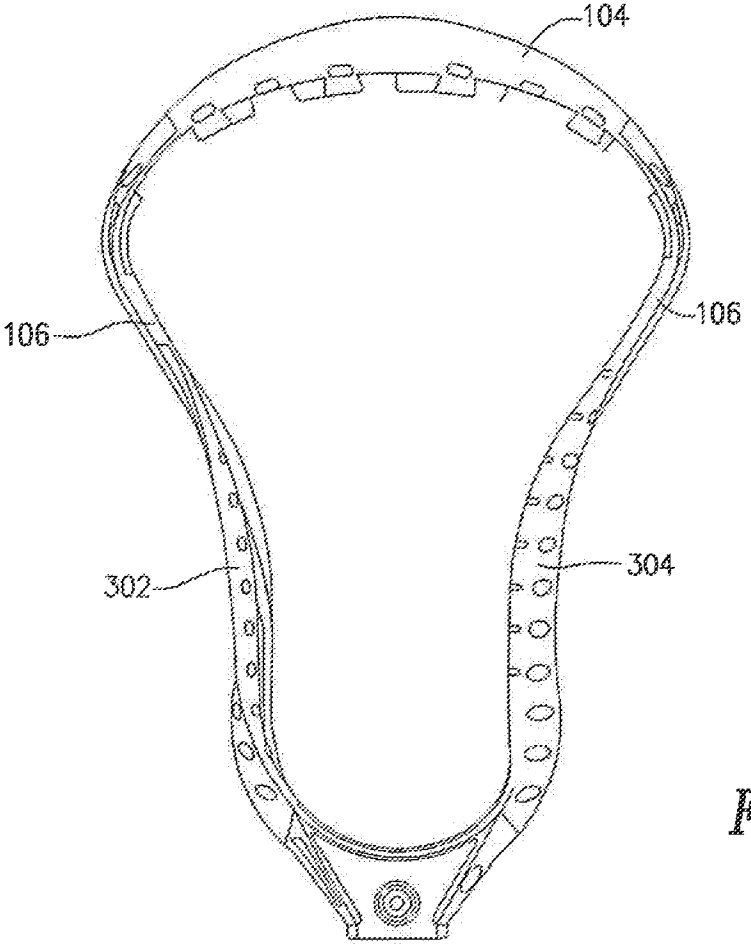
FIG. 3 is a back view of the lacrosse stick head configured for face-offs.

In FIG. 3, a back view of the lacrosse stick head configured for face-offs is shown. As shown in FIG. 3, the lower rails 106 on each side of the head 100 include angled edges running along the lower pocket area 109 of the head 100. Specifically, the right hand lower rail includes an edge 301 angled inward at approximately forty-five degrees relative to the lower rail 106 towards the lower pocket area 109. Similarly, the left hand lower rail includes an edge 302 angled outward at approximately forty five degrees relative to the lower rail 106 away from of the lower pocket area 109.

Figure 4:
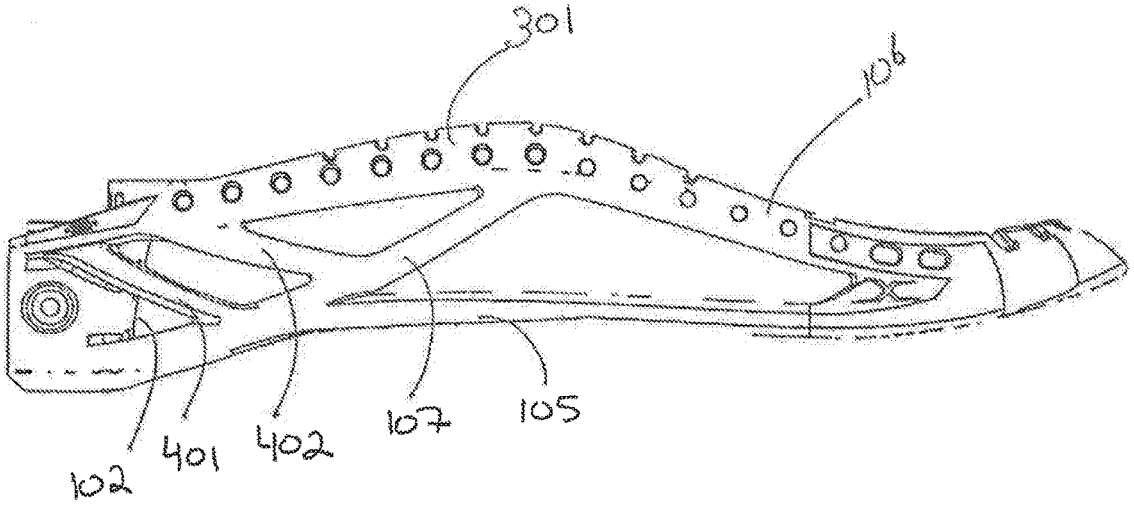
FIG. 4 is a right side view of the lacrosse stick head configured for face-offs.

In FIG. 4, a right side view of the lacrosse stick head configured for face-offs is shown. As shown in FIG. 4, the right side of the head 100 is that side of the head 100 with the lower rail edge 302 angled inward toward the lower pocket area 109. The support arm 107 on this side transitions from the upper rail 105 near the base region 102 to the lower rail 106 at the point where the lower region 109 of the head 100 transitions to the upper region 110. A first reinforcement arm 401 transitions from the lower rail 106 near the base region 102 to the upper rail 105 near the connection point of the support arm 107 on that upper rail 105. A second reinforcement arm 402 transitions from the lower rail 106 near the base region 102 to the support arm 107 approximately near the midpoint of the support arm 107.

Figure 5:
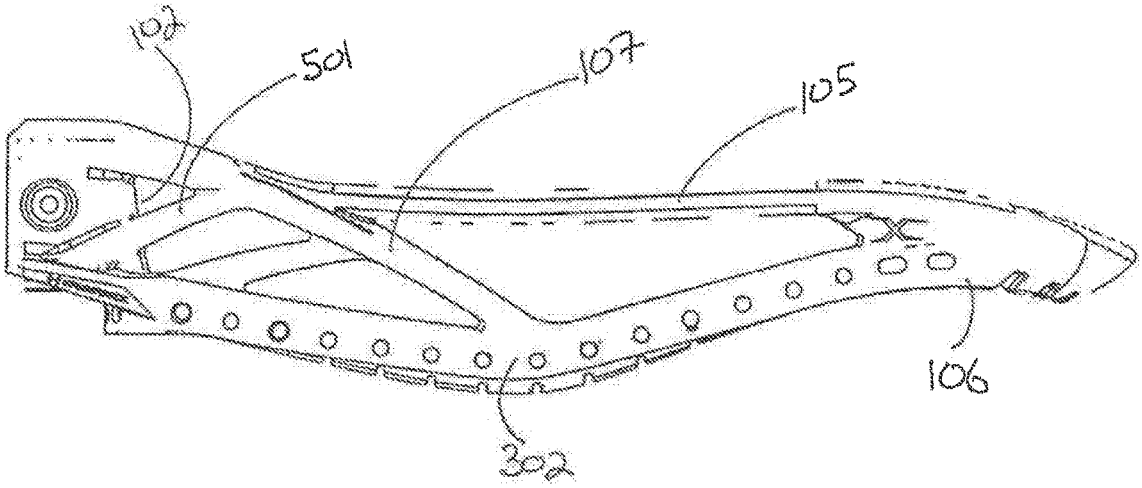
FIG. 5 is a left side view of the lacrosse stick head configured for face-offs.

In FIG. 5, a left side view of the lacrosse stick head configured for face-offs is shown. As shown in FIG. 5, the left side of the head 100 is that side of the head 100 with the lower rail edge 301 angled outward away from the lower pocket area 109. As with the right side of the head 100, the support arm 107 on the left side transitions from the upper rail 105 near the base region 102 to the lower rail 106 at the point where the lower region 109 of the head 100 transitions to the upper region 110. A first reinforcement arm 501 transitions from the lower rail 106 near the base region 102 to the upper rail 105 near the connection point of the support arm 107 to that upper rail 105.

What is claimed is:

1. A lacrosse head configured for face-offs, comprising:
a socket that attaches to a lacrosse stick shaft;
a base region adjacent to the socket;
upper rails extending from each of a right side and a left side of the base region;
lower rails extending from each of the right side and left side of the base region;
support arms connecting the lower rails to the upper rails on each of the right side and left side of the base region;
the lower rail on the right side of the base region including an edge angled outward away from the base regions; and
the lower rail on the left side of the base region including an edge angled inward toward the base region.

2. The lacrosse head of claim 1, further comprising a first reinforcement arm connecting the upper rail to the lower rail extending from each of the right side and the left side of the base region.

3. The lacrosse head of claim 2, further comprising a second reinforcement arm connecting the upper rail to the lower rail extending from the right side of the base region.

4. The lacrosse head of claim 1, wherein the upper rails extend in parallel from each of a right side and a left side of the base region to form a lower pocket region along approximately a lower half of a longitudinal axis of the head and then extend outward to form an upper pocket region along approximately an upper half of the longitudinal axis of the head.

5. The lacrosse head of claim 4, wherein the upper rails terminate to form a scoop at the top end of the head.

6. The lacrosse head of claim 1, wherein the lower rails include eyelets or other types of openings, to which a netting or another lacrosse pocket material may be connected.

7. The lacrosse head of claim 1, wherein the edge of the lower rail on the right side of the base region and the edge of the lower rail on the left side of the base region each are angles at approximately forty five degrees relative to the lower rails.

8. The lacrosse head of claim 4, wherein the support arms attach to each of the upper rails at a point approximately at a midpoint of the longitudinal axis of the head where the lower pocket region transitions to the upper pocket region.

9. A lacrosse head configured for face-offs, comprising:
a socket that attaches to a lacrosse stick shaft;
a base region adjacent to the socket;
upper rails extending from each of a right side and a left side of the base region;
lower rails extending from each of the right side and left side of the base region;
support arms connecting the lower rails to the upper rails on each of the right side and left side of the base region;
the lower rail on the right side, adjacent to the base region, is disposed outward in relation ship to right side upper rail; and
the lower rail on the left side, adjacent to the base region, is disposed inward in relationship to the left side upper rail.

* * * * *